United States Patent [19]

Diba et al.

[11] Patent Number: 4,777,693

[45] Date of Patent: Oct. 18, 1988

[54] SCRAPER CARRYING CONTAINER FOR LOTTERY TICKETS

[76] Inventors: Keyvan T. Diba, 11841 Goshen Ave., Apt. 4, Los Angeles, Calif. 90049; Allan M. Shapiro, 15315 Magnolia Blvd., Suite 105, Sherman Oaks, Calif. 91403

[21] Appl. No.: 900,637

[22] Filed: Aug. 27, 1986

[51] Int. Cl.[4] ..... A47L 13/02

[52] U.S. Cl. ..... 15/236.01; 15/105; 15/111

[58] Field of Search ..... 15/236 R, 111, 105, 15/236 A; 206/39

[56] References Cited

U.S. PATENT DOCUMENTS

| | | | |
|---|---|---|---|
| 934,220 | 9/1909 | Sayles | 206/39 |
| 1,062,174 | 5/1913 | Long | 206/39 X |
| 3,421,658 | 1/1969 | Cooksey | 206/39 X |
| 4,045,102 | 8/1977 | Austin | 206/39 X |
| 4,549,327 | 10/1985 | Johnson | 15/236 R |
| 4,654,923 | 4/1987 | Faciane et al. | 15/236 R |
| 4,662,518 | 5/1987 | Chiapetta et al. | 206/39 X |
| 4,674,628 | 6/1987 | Prinsloo et al. | 206/39 X |

*Primary Examiner*—Chris K. Moore

*Attorney, Agent, or Firm*—Allan M. Shapiro

[57] ABSTRACT

A body carries a scraper, abraider, and/or stiff brush for the removal of a coating layer covering game symbols on a lottery ticket. The body may be a container for carrying therein a plurality of such lottery tickets packaged for sale. Also it may be employed to retain winning tickets. The scraper, abraider, and/or stiff brush may have a guide associated therewith to limit scraping, abraiding and brushing to the position on the ticket where the game symbols are located.

9 Claims, 4 Drawing Sheets

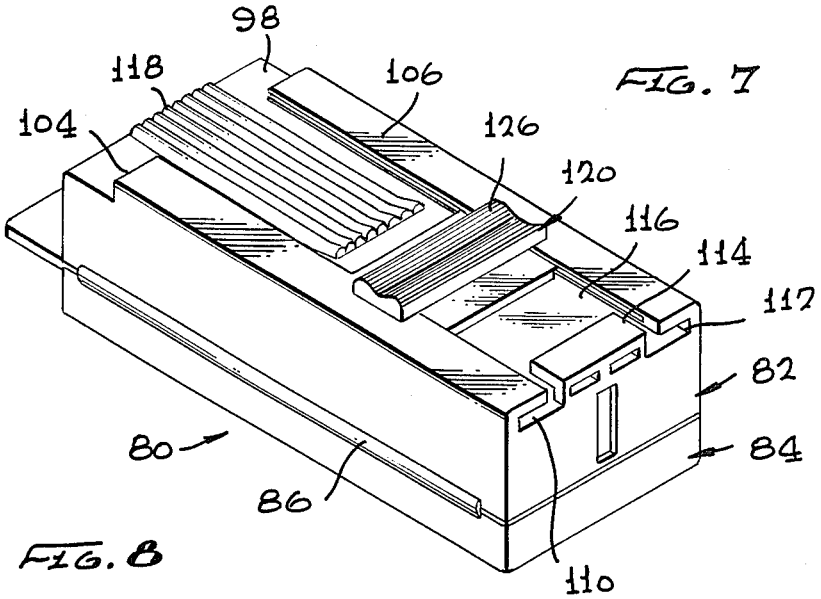
FIG. 7
FIG. 8
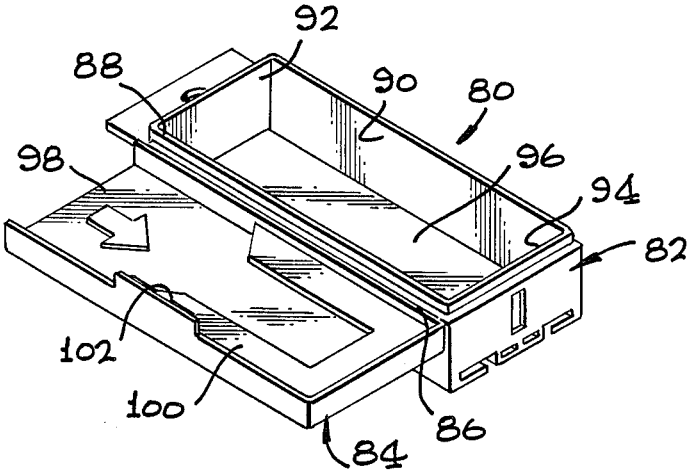
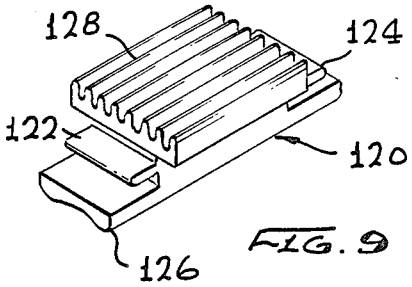
FIG. 9
FIG. 11
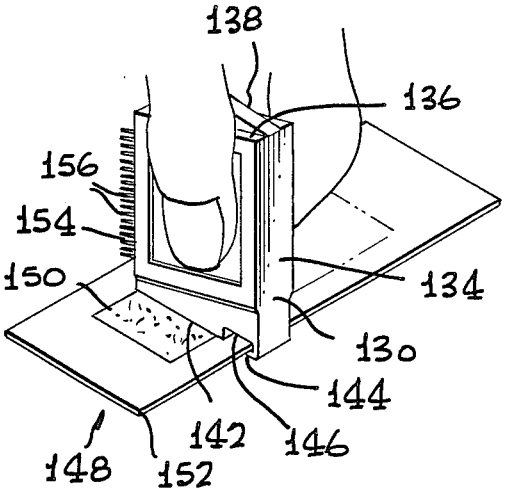
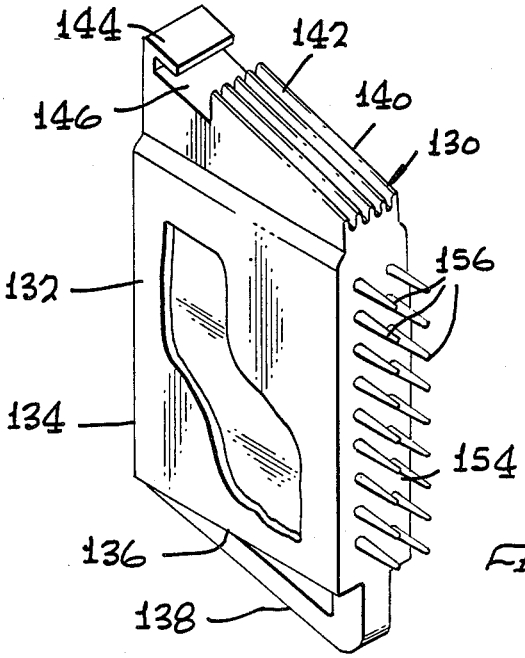
FIG. 10

FIG. 12
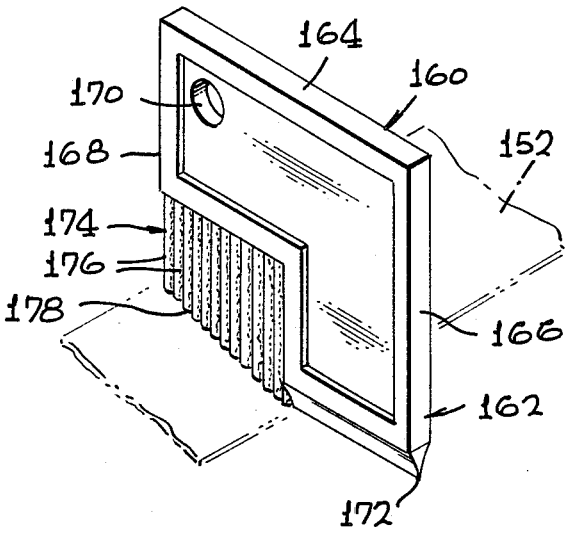
FIG. 13
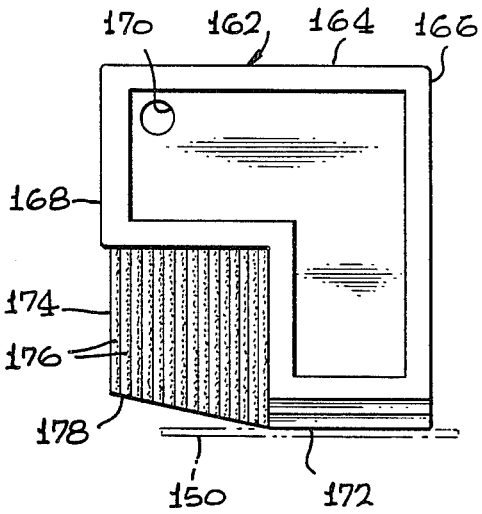
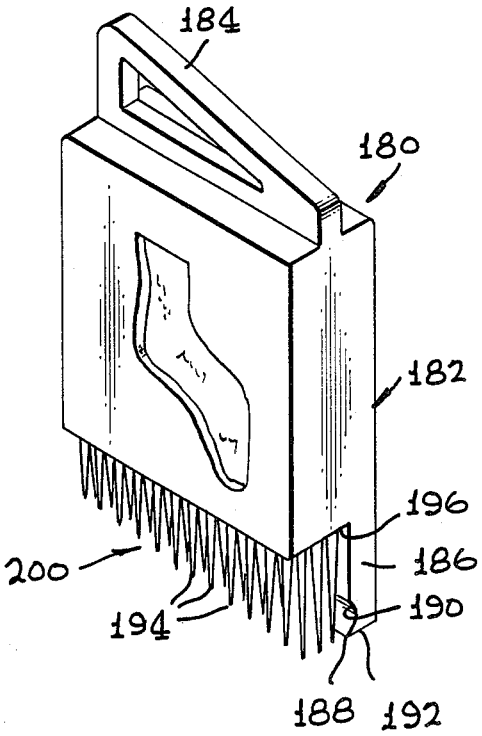
FIG. 14
FIG. 15
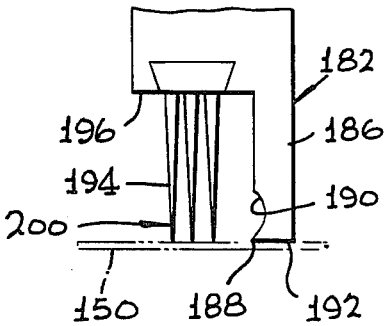

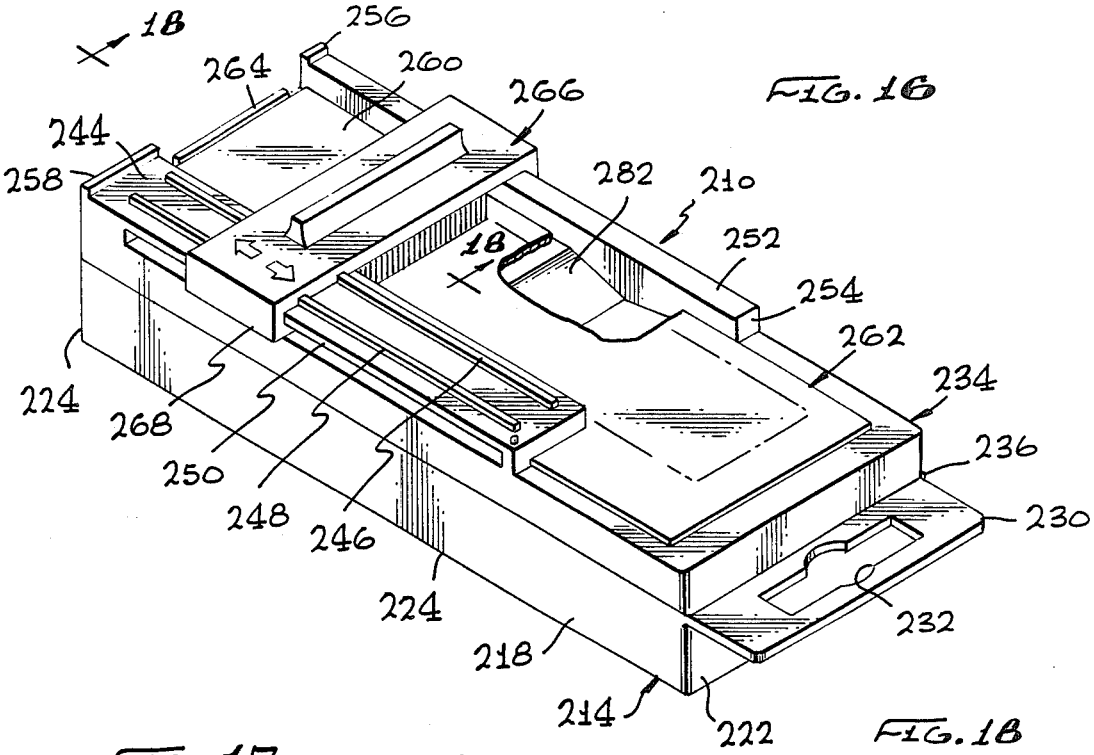
FIG. 16
FIG. 17
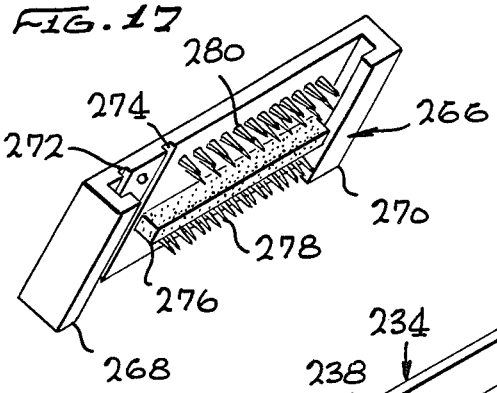
FIG. 18
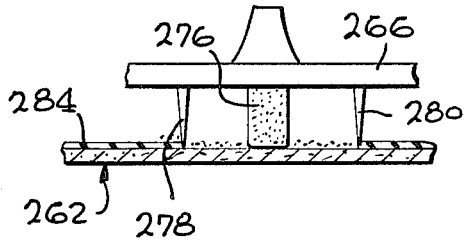
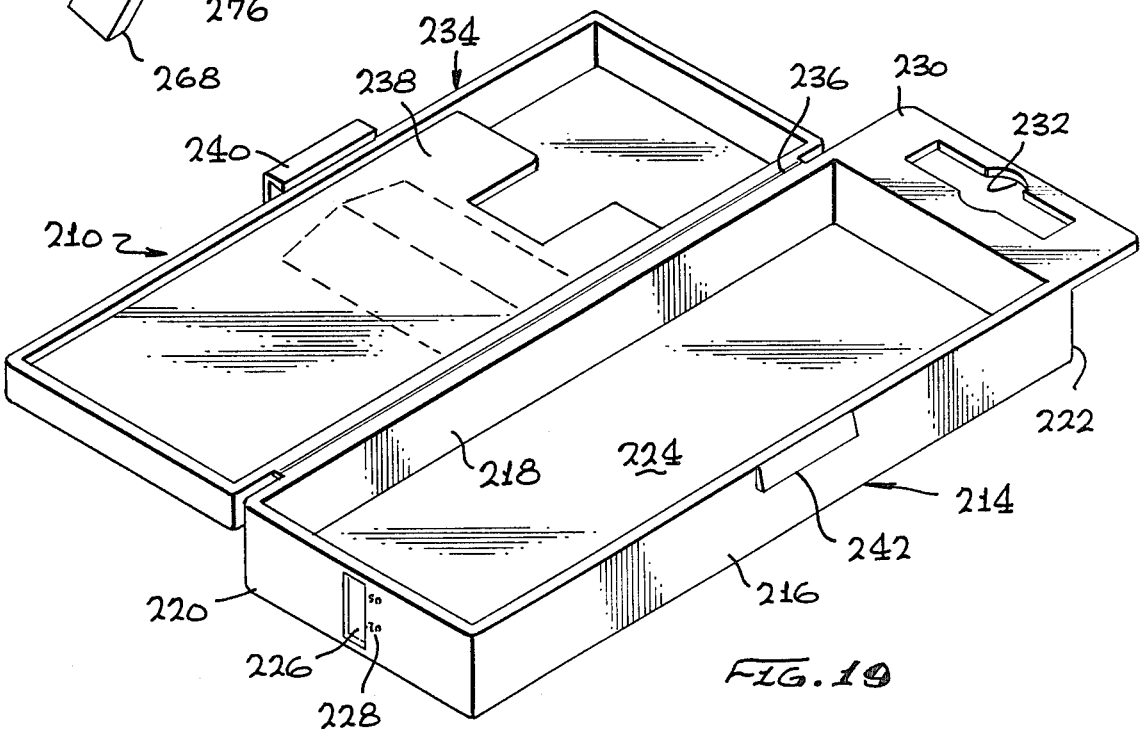
FIG. 19

SCRAPER CARRYING CONTAINER FOR LOTTERY TICKETS

BACKGROUND OF THE INVENTION

This invention is directed to scrapers particularly suited for removing the coating layer on a lottery ticket over the game symbols printed thereon so as to expose the game symbols for visual inspection. The scraper may have a cavity in its body for the containment of lottery tickets.

In some government jurisdictions, lotteries are legal. These lotteries are often produced, managed and protected by a governmental entity. Many present-day lotteries have as the principal gaming piece individual tickets which are sold to the gambler. These tickets have printed thereon a series of symbols, and the rules of the lottery provide that a payoff will be made to the holder of a certain combination of symbols. In order to prevent selective lottery ticket purchasing, the symbols are covered with an opaque layer prior to purchase. After purchase, the buyer remove a portion of the opaque layer in order to inspect his combination of symbols to determine whether or not he is entitled to an award payoff.

In order to provide protection to the lottery system, a numerical or other series is also printed on the front of the ticket at the same time that the symbols are printed thereon. This numerical series serves to confirm the symbol combination on the winning ticket and permits the lottery operators to inspect for lottery tickets which have been physically manipulated or for completely counterfeit tickets. In order to maintain the integrity of the numerical series which serves as a proof number, the numerical series is covered with the same opaque coating. The lottery rules require that the coating over the proof number numerical series remain in place until the winning ticket is inspected by employees of the lotter operator. Thus, the scraping off of the coating must be selective. Any appropriate scraper is desirable to remove that portion of the coating which hides the game symbols from visual inspection. It is also appropriate that a guide be associated with the scraper in order to quickly remove the coating over the game symbols without removing the coating over the proof number numerical series.

In order to serve the largest market, the cost of such lottery tickets is usually kept low. Currently, one dollar is a common price for such lottery tickets. The lottery tickets are usually sold as individual items. Since some gamblers prefer to gamble with more money than will buy just a few tickets, a large number of tickets must be individually transferred with a large sale of tickets. Thus, it is also desirable to package tickets in groups so that they may be sold in groups.

SUMMARY OF THE INVENTION

In order to aid in the understanding of this invention, it can be stated in essentially summary form that it is directed to a scraper which can be manually manipulated and employed to scrape the coating layer covering off of the game symbols on a lottery ticket. The scraper has a body which has a surface thereon to act as a scraper, abraider, and/or a stiff brush to remove the selected portion of the coating layer, and the body also has sufficient structure to be manually grasped so that the scraper active surface can be moved with respect to the coating layer.

It is, thus, an object and advantage of this invention to provide a scrape which can be manually manipulated to remove the coating layer over the game symbols on a lottery ticket so that the user can quickly, accurately and conveniently remove the selected portion of the coating layer so that he may observe the game symbols exposed by removal of the coating layer.

It is another object and advantage of this invention to provide an inexpensive scraper for scraping selected portion of the coating from a lottery ticket wherein the scraper is sufficiently inexpensive to serve as a container in which lottery tickets can be sold.

It is a further purpose and advantage to provide a scraper for lottery tickets wherein the scraper is small and inexpensive and can be carried with the user for use whenever he purchases a lottery ticket.

The features of the present invention which are believed to be novel are set forth with particularity in the appended claims. The present invention, both as to its organization and manner of operation, together with further objects and advantagees thereof, may be best understood by reference to the following description, taken in conjunction with the accompanying drawings.

BRIEF DESCRIPTION OF THE DRAWINGS

FIG. 7 is an isometric view of a second preferred embodiment of the scraper of this invention.

FIG. 8 is an isometric view of the bottom of the scraper shown in FIG. 7, with the bottom cover open to show the interior thereof.

FIG. 9 is an isometric view of the bottom of the movable scraper member of the scraper of FIG. 7.

FIG. 10 is a perspective view of the third preferred embodiment of the scraper of this invention.

FIG. 11 is a perspective view showing the scraper of FIG. 10 employed in connection with scraping a selected portion of the coating layer off of a lottery ticket.

FIG. 12 is a perspective view of another construction of the third preferred embodiment of the scraper of this invention, wherein the scraper is a single unit held between the fingers.

FIG. 13 is a side-elevational view thereof.

FIG. 14 is another construction of the third preferred embodiment of the scraper of this invention wherein the scraper is held between the fingers.

FIG. 15 is an enlarged end-elevational view thereof, with parts broken away.

FIG. 16 is a fourth preferred embodiment of the scraper of this invention, similar to the scraper of FIG. 7 wherein the body of the scraper has storage space therein and wherein there is a movable scraper member.

FIG. 17 is a bottom perspective view of the scraper member showing its scraping component.

FIG. 18 is an enlarged section taken generally along the line 18—8 of FIG. 16, with parts broken away.

FIG. 19 is an isometric view of the body of the scraper of FIG. 16 showing the body open with the storage space exposed.

DESCRIPTION OF THE PREFERRED EMBODIMENTS

Figures 1, 2, 3, 4, 5, 6:
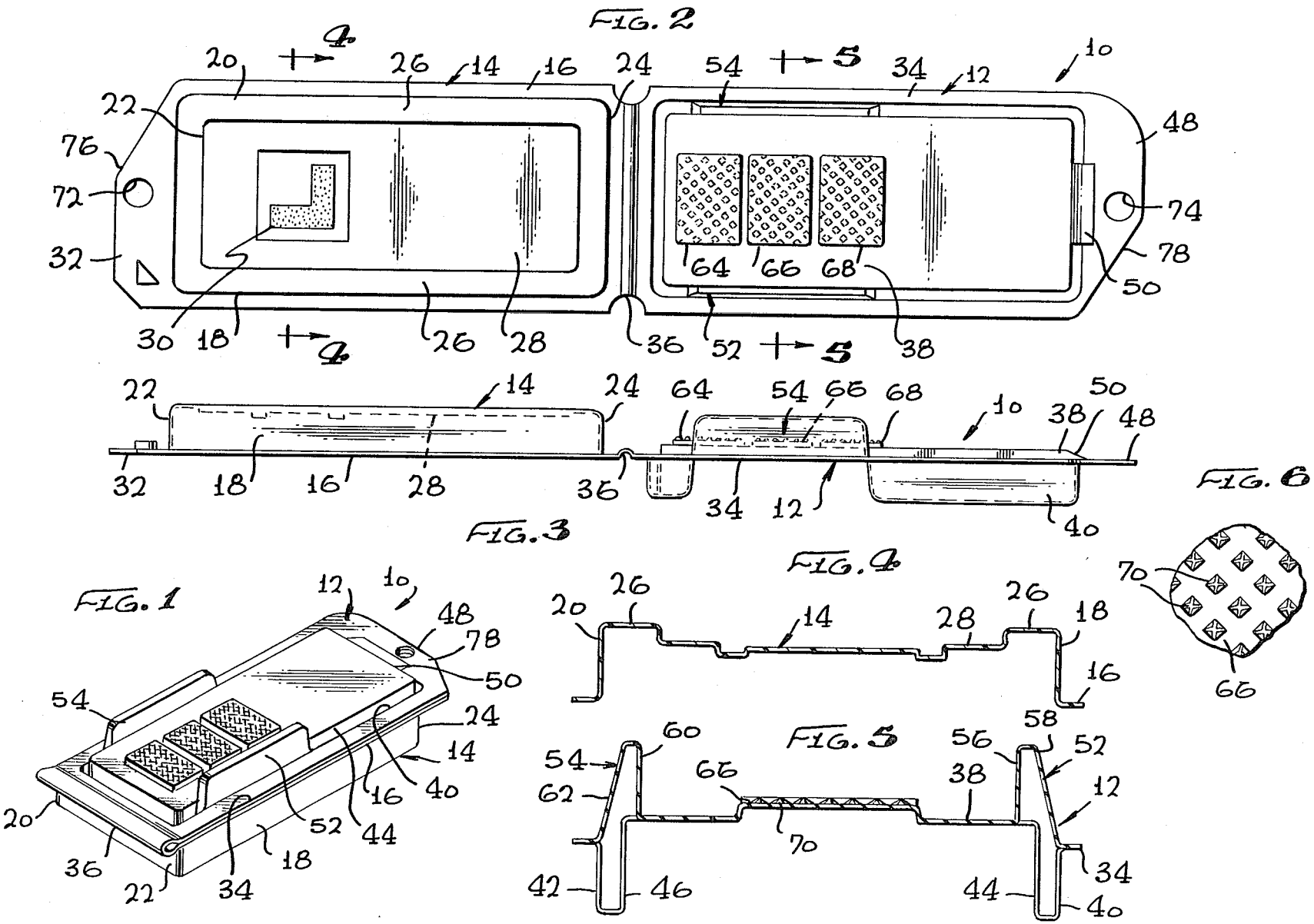
FIG. 1 is an isometric view of the first preferred embodiment of the scraper of this invention.
FIG. 2 is a plan view of the scraper of the scraper of FIG. 1, showing it in the unfolded position.
FIG. 3 is a side-elevational view thereof.
FIG. 4 is an enlarged section taken generally along the line 4—4 of FIG. 2.
FIG. 5 is an enlarged section taken generally along the line 5—5 of FIG. 2.
FIG. 6 is an enlarged view of a portion of the structure in FIG. 2, with parts broken away.

FIGS. 1 through 6 show the first preferred embodiment of the scraper of this invention. In this embodiment, the scraper is generally indicated at 10 and is in the form of a box having a scraper surface and guides thereon. The box has a top 12 and bottom 14. The designations top and bottom are chosen for these portions of the box on the basis that the top has the scraper portion thereon, while the bottom only serves as a closure. The scraper 10 is formed of thermoplastic synthetic polymer composition material and is formed of a flat sheet thereof by vacuum-forming. Thus, the thickness of the various parts of the scraper is substantially uniform. The thickness and the choice of materials is sufficient to provide some resiliency in the box, but still have sufficient rigidity to maintain its box shape and its scraper function. Vacuum-forming from a sheet of clear polyvinyl chloride (?) of 0.020 inch thickness provides the requisite strength and resiliency. The upper level of the bottom 14 of the box is defined by flange 16 which lies in a plane where the edges of the plane define the periphery of the box. Depending downwardly from the flange 16 are side walls 18 and 20 and end walls 22 and 24. Bottom wall 26 joins the side walls and end walls to enclose the bottom. In order to provide additional strength to the bottom wall, raised boss 28 is slightly raised from the general plane of the bottom wall towards the plane of flange 16. If desired, a symbol 30 may be vacuum-formed into the bottom wall for identifying purposes. The left end of flange 16, as seen in FIGS. 2 and 3, extends in a tab 32 beyond end wall 22.

Flange 16 is joined with flange 34 of box top 12 through a self-hinge 36. As seen in FIG. 3, the self-hinge is in the form of a hemicylindrical bend above the plane of flanges 16 and 34. These two flanges lie in the same plane when the box is open, as shown in FIGS. 2 and 3. In order to form a box 12 which both has walls which extend down into the box bottom and support the top wall 38 above the plane of flange 34, the entrance side and end walls are used on the box top. Side walls 40 and 42 extend down from flange 34 and are positioned to be resiliently received between side walls 18 and 20 in the box bottom. Inner side walls 44 and 46 extend upward from the bottom of the side walls 40 and 46 and join top wall 38, as seen in FIG. 5. The top wall 38 is slightly above the plane of flange 34. As seen in FIGS. 2 and 3, the end walls of box top 12 are similarly formed. At tab 48 on flange 34, on the right end of FIGS. 2 and 3, the end wall and inner end wall do not extend all the way across the end of the box top. Instead, ramp 50 directly joins top wall 38 and tab 48 to interrupt the end wall and inner end wall. At the left end of the box top, the end wall and inner end wall are uninterrupted, as shown in FIGS. 2 and 3.

The re-entrance side wall formed of side wall 40 and inner side wall 44, and also the re-entrance side wall formed of side wall 44 and inner side wall 46 are interrupted by the formation of upstanding guide flanges 52 and 54. These are formed as double wall flanges in the same manner as the side walls, but extending upward from flange 34. As is seen in FIG. 5, guide flange 52 has inner and outer walls 56 and 58, while guide flange 54 has inner and outer walls 60 and 62. These walls are spaced from each other, and in the present instance, are spaced somewhat inwardly from inner side walls 44 and 46. Between the guide flanges are raised bosses 64, 66 and 68, with raised boss 66 shown in detail in FIG. 5. Each of the raised bosses carries upwardly directly sharp-edged dimples thereon. One of the dimples is indicated at 70 in FIGS. 5 and 6 and is shown in more detail in FIG. 6. The dimples are formed by sharp projections in the vacuum-forming mold so that sharp edges of the perforated polymer film are left projecting upwardly. The raised bosses and the dimples are spaced from the guide flanges 52 and 54, as shown in FIG. 2.

As is previously described, the scraper 10 of this invention is particularly useful for the packaging, sale and scraping of lottery tickets. A group of stacked or accordion-folded lottery tickets is packaged in the box 10, which is closed by having the side walls and end walls thereof interengaged. The tabs 32 and 48 lie against each other, as do the flanges 16 and 34. The box is sealed by engaging a wrapper at least around tabs 32 and 48. When closed, the holes 72 and 74 line up so that the closed box may be hung on a pin. Furthermore, the overlapping tabs have cutaway corners 76 and 78 so that fingers can engage the facing tab for easy opening of the box. After the box is opened and the lottery tickets removed, the coating layer covering the game symbols on the lottery ticket may be quickly and easily removed by sequentially rubbing the lottery tickets over the dimples on the various bosses between the guide flanges. The size of the raised bosses and their positioning between the guide flanges is such that, when the tickets are rubbed thereacross, the coating layer is only removed from the game symbols by scraping, abraiding or stiff brushing action. That portion of the coating layer which is positioned over the numerical series which serves as a proof number is not removed. In this way, a convenient, inexpensive, secure packaging and scraping device for lottery tickets is achieved.

Scraper 80, shown in FIGS. 7 and 8, is the second preferred embodiment of the scraper of this invention. Like scraper 10, scraper 80 has a box top 82 and a box bottom 84. In FIG. 7, the box is closed with the top towards the viewer, and, in FIG. 8, the box is open with the bottom towards the viewer. The scraper 10 was designed for vacuum-forming, while the scraper 80 is designed for injection-molding. Thus, the material of scraper 80 is injection-moldable thermoplastic synthetic polymer composition material such as polyethylene or polypropylene. The top and bottom are joined by self-hinge 86. As is seen in FIG. 8, side walls 88 and 90, end walls 92 and 94, together with top wall 96 form an enclosure or space which can receiver lottery tickets. Box bottom 84 includes bottom wall 98 with dependent edges which overlap the walls of the top, shown upstanding in FIG. 8. Box bottom 84 also has a U-shaped web 100 spaced from bottom wall 98 so that selected tickets may be pocketed behind the web. Resilient latch 102 is integrally formed with bottom 84. The size of the space within the box is such that it may serve as a container for a predetermined number of lottery tickets, such as fifty tickets. Such tickets may be separate, or they may be accordion-folded.

The scraper 80 is also configured so that the coating layer over the game symbols can be quickly and easily removed without removing the portion of the coating layer over the proof number series. As is seen in FIG. 7, wings 104 and 106 are attached to the side walls and positioned above top 96 so as to define slots 110 and 112.

These slots have a sufficient overall width and an adequate thickness to accept a lottery ticket inserted therein in the longitudinal direction. Stop 114 is mounted on top 96 adjacent one end thereof. On the end of the top towards stop 114 is a flat support surface 116. The support surface is above the longitudinally grooved entry surface 118. Scraper/slider 120 is shown removed and inverted in FIG. 9. It has flanges 122 and 124 which are respectively inserted in slots 112 and 110. Thumb engagement surface 126 permits the slider to move the length of the slots. When over the entry surface 118, there is sufficient clearance below the scraper surface 128 to permit a lottery card to be easily thrust therebeneath to position against stop 114. Then, as the thumb holds the lottery ticket in place, the scraper/slider 120 is moved towards the stop 114 and returned to the starting position. The double stroke causes the scraper surface 120 to remove the coating layer from the portion of the ticket where it covers the game symbols. The scraper lottery ticket can be easily removed for inspection. If desired, winning tickets can be placed in the pocket formed in the bottom. The width of the scraper surface 128 in the direction lateral to its motion and its positioning in the direction lateral to its motion is such that the coating layer is removed only from above the game symbols and not from the proof number series. In this way, a lottery ticket can be quickly and easily scraped.

FIGS. 10 through 15 show the third preferred embodiment of the scraper of this invention. In this third preferred embodiment, the scraper is a flat, injection-molded part which can be grasped between thumb and forefinger. The scraper has a scraping and a brushing surface thereon so that the scraper may be manipulated to remove the desired portion of the coating layer. FIGS. 10 and 11 show the scraper 130 which has a body 132 of generally rectangular configuration. The body is injection-molded of thermoplastic synthetic polymer composition material and is sufficiently thick to be adequately strong, in view of the flexibility of the material of which it is molded, and is of thickness appropriate for grasp between the thumb and forefinger. The body has four edges with edge 134 being a plain edge. Hanging edge 136 has a loop 138 thereon. The loop is appropriate for hanging the scraper 130 on a key ring, key chain, or key holder. When attached in that way, the scraper 130 is always available to the user. Scraper edge 140 has a plurality of longitudinal scraper edges 142 running in the direction along the edge. These scraper ridges are configured to readily scrape the coating layer off of the face of a lottery ticket. Edge guide 144 is in the form of a hook having its open side facing the scraper ridges 142. The edge guide has a relieved surface 146 above the level of scraper ridges 142 in a direction away from the lottery ticket. In FIG. 11, lottery ticket 148 is illustrated as having a coating area 150 which is away from the edge 152 of the lottery ticket. When the edge guide 144 is hooked over the edge 152, the relief 148 prevents scraping of the coating material adjacent the edge 152 of the lottery ticket 148.

Brush edge 154 is between the edges 136 and 140. It carries thereon a plurality of projecting brush bristles 156. The bristles are molded of the same material as the body and are of such diameter versus their length, in accordance with the particular material of which they are made so that they are somewhat flexible for the purpose of brushing off the loose material which has been scraped from the surface. Furthermore, the brush bristles are preferably sufficiently stiff so that they may alternatively be employed for the scraping function.

The third preferred embodiment of the scraper of this invention in its second version is generally indicated at 160 in FIGS. 12 and 13. Scraper 160 has a substantially rectangular body 162 with two plain edges 164 and 166 at right angles to each other. Plain edge 168 defines the third side of the body. An opening 170 permits the placement of the scraper on a key ring, a key chain, and the like. As with scraper 130, the body 162 is of such thickness as to permit it to be grasped between thumb and forefinger and manipulated. To aid in the manipulation, to conserve material and yet provide adequate strength, the scraper 160 has a raised rim around its edges. In the scraper 160, it is the fourth edge which carries the structure by which the scraping is achieved. Scraper edge 172 is formed on the lower edge of body 162. The length of scraper edge 172 is such as to reach completely across all of the game symbols on the lottery ticket so that they may be scraped at one time. In order to aid in the cleaning of the scraped-off coating layer, brush 174 is provided on the lower edge of body 162 adjacent scraper edge 172. Brush 174 comprises a plurality of molded brush bristles 176 which are formed of the same material as the body and are molded concurrently therewith. The brush bristles have such length and such thickness, consistent with the material with which they are molded, to be of the proper resiliency. The tips of the brush bristles are formed at an angle so that the brush face 178 is raised above the surface of the lottery ticket when the scraper edge is employed, and the scraper edge is away from the surface of the lottery ticket when the brush is employed.

The third preferred embodiment of the scraper of this invention, in its third version, is generally indicated at 180 in FIG. 14. The scraper is also shown in enlarged end view in FIG. 15, with the top portion of the scraper broken away. Scraper 180 has a body 182 of rectangular configuration and of such size as can be grasped between the thumb and forefinger and manipulated thereby. The body and its appurtenances are injection-molded of thermoplastic synthetic polymer composition material as a unitary structure. The top carries a loop 184 so that the scraper may be attached to a key ring, a key chain, or the like. In this sense, the scraper 160 could carry such a loop, or the scrapers 130 or 180 could have a hole through the body such as disclosed for scraper 160. The lower edge of body 180 is the scraper edge. Scraper blade 186 extends downward as part of the body and terminates in scraper edge 188. The scraper edge is defined by concavity 190 extending along the length of the scraper blade to define a sharp scraper edge at the bottom thereof. The lower face 192 of scraper blade 186 defines a plane with the edge 188 lying on the plane. As the scraper blade is drawn across the coating material on the lottery ticket, it scrapes it loose.

A plurality of brush bristles 194 are attached to downwardly facing shoulder 196 and terminate in brush face 198, which lies in the same plane as the lower face 192. The brush 200 formed by these bristles brushes away the loose coating material after it has been scraped free by scraper blade 186. Furthermore, the brush also serves to loosen the coating material as the scraper is employed. In this case, the scraper is swept back and forth over the surface of the lottery ticket where it is desired that the coating layer be removed. This third preferred embodiment of the scraper, in all three versions thereof, provides a scraper which is small so that it can be easily carried and readily manipulated.

FIGS. 16 through 19 show the fourth preferred embodiment of the scraper of this invention. This fourth preferred embodiment is generally indicated at 210 in FIGS. 16 and 19. The scraper 210 is somewhat similar to the scraper 80, which is the second preferred embodiment, because these two structures are made by injection-molding and they have a separately movable scraper slider. Scraper 210 is also similar to the first preferred embodiment because it has an openable body with a lottery storage ticket space therein. In FIG. 16, the scraper 210 is shown in the nominally upright position, and in FIG. 19, it is shown in the same position with the box top open. Box 212 forms the body of scraper 210. Box bottom 214 includes side walls 216 and 218 which are joined with end walls 220 and 222 and bottom wall 224. The walls define a space therebetween which can receive a plurality of lottery tickets, either stacked or accordion-folded. View slot 226 is formed in end wall 220 so that the number of lottery tickets therein can be inspected. Indicia 228 can be positioned adjacent the U-slot so that the number of lottery tickets within the box can be inspected. Flange 230 is formed on one end of the box bottom and has an opening 232 therein so that the box can be hung from a peg or the like.

Box top 234 is joined to box bottom 214 by means of a self-hinge 236 so that the box top can be hinged over to the closed position shown in FIG. 16 wherein the interior of the box body is enclosed to retain the lottery tickets therein. Web 238 can be formed across the interior of the top to define a pocket into which selected lottery tickets, such as winning tickets, can be placed. Resilient latch 240 is formed on box top 234 and is dimensioned to resiliently engage upon keeper 242 to maintain the box top in closed position until the latch is released.

As is seen in FIG. 16, the box top has an inwardly directed flange 244 which has guide rails 246 and 248 on the top thereof. Slot 250 is formed in the side of the top directly below the flange. A similar slot, not shown, extends parallel to slot 250 just below the top edge 252 of the raised side wall 254 at the far side of FIG. 16. Stop 256 is formed at the left end of side wall 254, and stop 258 is formed at the left end of flange 244. Recess 260 lies between side wall 254 and underneath flange 244. The recess is of such size as to receive a lottery ticket 262. The lottery ticket is inserted lengthwise into the recess under flange 244 until it engages stop 264. Scraper slider 266 is configured to reach over flange 244 and top edge 252. It has guides 268 and 270, see FIG. 17, which respectively engage in slot 250 and the unseen slot in side wall 254. In addition, guide slots 272 and 274 engage over rails 248 and 246 respectively so that the scraper slider 266 may slide the length of flange 244. At the left end of FIG. 16, the slider is stopped by stops 256 and 258. At the right end, it is stopped by the engagement of guides 268 and 270 in their slots which terminate. The underside of scraper slider 266 is provided with scraper 276 and brushes 278 and 280. The brushes are formed of bristles which are integrally molded with the scraper slider.

Recess 260 has a substantially planar bottom over a substantial part of its length. It has a depression 282 under the slider when the slider is in its rightmost position. The length of the scraper 276 and brushes associated therewith is such that, when the slider is over depression 282, the lottery ticket 262 can be inserted from the right end of FIG. 16 underneath flange 244 through stop 264. The length of the scraper and brushes is such that, when the slider is moved to the left, the scraper and brushes come into contact with the coating layer 284, see FIG. 18, to scrape, abraid and brush away the coating layer as indicated in FIG. 16. The lottery ticket is inserted so that the portion of the coating layer to be scraped away is inserted first into the scraper 210, and the portion of the coating layer which is not to be removed is protected under flange 244. After the coating layer over the game symbols is scraped and brushed away, slider 266 is moved over depression 282 to release the lottery ticket. Thereupon, it can be withdrawn out of the scraper 210 for inspection, discard, or retention for the claiming of a prize. Thus, each of the scrapers described permits the holder of the lottery ticket to quickly and accurately remove the coated layer over the game symbols.

While each of the versions of the scraper in the third preferred embodiment is illustrated and described as being of generally rectangular shape, it is clear that other sizes and shapes will fulfill the functional requirements. The basic requirements are that the scraper be of sufficient lateral dimension to be grasped between thumb and forefinger. The distance between edges should be larger than the thumb in order to be comfortably grasped. A recess between the edges, such as is shown in each of the three versions of this embodiment, aid in such grasp. Furthermore, the distance between the grasping surfaces, that is, in the direction of the grasping force, must be sufficiently small that it is comfortable when grasped in that way. The shape of the edge of the body is unimportant, except that one edge be straight so that it can carry a scraper edge. When provided with a brush, the tips of the bristles should lie substantially along a straight line so that the bristles work together in scraping and brushing. Other characteristics of the scraper of the third preferred embodiment include an opening in the scraper body so that the scraper can be hung on a key ring and the like. Furthermore, the scraper should be designed so that it can be manufactured by injection-molding with a minimum amount of thermoplastic synthetic polymer composition material so that fast molding cycles and inexpensive product result.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A scraper carrying container comprising:

a body, said body being in the form of a box having a box bottom and a box top, said box top interfitting with said box bottom to enclose a space therein, with the space being sized to receive lottery tickets;

said box top having a top surface, at least one guide positioned with respect to said top surface for guiding a lottery ticket along said top surface; and scraper means associated with said top surface and positioned with respect to said guide for scraping at least a portion of the coating layer off of a lottery ticket as it is moved along said box top on a path guided by said guide.

2. The scraper carrying containers of claim 1 wherein said scraper means comprises scraper surface on said top surface adjacent said guide.

3. The scraper carrying container of claim 2 wherein said top surface has edges and there are first and second guides, said guides being positioned adjacent said opposite edges of said top surface, said scraper surface being positioned therebetween.

4. The scraper carrying container of claim 3 wherein said scraper surface faces upwardly from said box top and said box top is without a stop to permit rubbing motion of a lottery ticket on said scraper surface by sliding it between said guides.

5. The scraper carrying container of claim 4 wherein said box top and said box bottom are integrally formed with a self-hinge in between formed concurrently therewith.

6. The scraper carrying container of claim 5 wherein said scraper carrying container is configured to be formed by the vacuum forming of thermoplastic synthetic polymer composition sheet material.

7. The scraper carrying container of claim 1 wherein said top surface has first and second edges and there are first and second guides respectively positioned adjacent said first and second edges.

8. The scraper carrying container of claim 1 wherein said box top and said box bottom are integrally formed with a self-hinge in between formed concurrently therewith.

9. The scraper carrying container of claim 1 wherein said scraper carrying container is configured with curves, spaces and depths and of such material that it can be formed by the vacuum forming of thermoplastic synthetic polymer composition sheet material.

* * * * *